US010883273B2

(12) United States Patent
deLoache, III et al.

(10) Patent No.: US 10,883,273 B2
(45) Date of Patent: Jan. 5, 2021

(54) COMBINABLE LIGATURE-RESISTANT GRAB BAR FOR VERTICAL AND HORIZONTAL APPLICATION

(71) Applicant: BEHAVIORAL SAFETY PRODUCTS, LLC, Watkinsville, GA (US)

(72) Inventors: Robert Lee deLoache, III, Watkinsville, GA (US); David Cory deLoache, Watkinsville, GA (US); Mark Mendes, Loganville, GA (US)

(73) Assignee: BEHAVIORAL SAFETY PRODUCTS, LLC, Athens, GA (US)

( * ) Notice: Subject to any disclaimer, the term of this patent is extended or adjusted under 35 U.S.C. 154(b) by 206 days.

(21) Appl. No.: 16/189,504

(22) Filed: Nov. 13, 2018

(65) Prior Publication Data

US 2020/0149286 A1 May 14, 2020

(51) Int. Cl.

| | |
|---|---|
| ***E04F 11/18*** | (2006.01) |
| ***A47K 17/02*** | (2006.01) |
| ***E05B 1/00*** | (2006.01) |

(52) U.S. Cl.

CPC ..... *E04F 11/1802* (2013.01); *A47K 17/022* (2013.01); *E05B 1/0015* (2013.01); *E04F 2011/1868* (2013.01)

(58) Field of Classification Search

CPC . A47K 17/022; Y10T 16/458; E04F 11/1802; E04F 11/1804; E04F 11/1808

See application file for complete search history.

(56) References Cited

U.S. PATENT DOCUMENTS 3,156,944 A * 11/1964 Bohn ..... E05B 1/0015 16/412
5,050,750 A * 9/1991 Mason ..... A47B 96/02 211/105.1

(Continued)

FOREIGN PATENT DOCUMENTS

| | | |
|---|---|---|
| CN | 201447911 | 5/2010 |
| CN | 201447912 | 5/2010 |

(Continued)

OTHER PUBLICATIONS

U.S. Appl. No. 15/987,295, filed May 23, 2018, deLoache, III, et al.

(Continued)

*Primary Examiner* — Michael P Ferguson

(74) *Attorney, Agent, or Firm* — Mitch Harris, Atty at Law; Andrew M. Harris

(57) ABSTRACT

A ligature-resistant grab bar provides ligature-proof self-support of persons at toilets, showers, baths or other locations where persons require self-support assistance. The ligature-resistant grab bar includes an elongate body that may be an extruded member, which has a flange disposed at a planar rear surface extending from the elongate body on a first side and a second side of the elongate body. The sides of the elongate body have curved side channels for drainage of water that extend from an inner edge of the flange toward a central axis of the elongate body to a gripping profile forming a front of the elongate body, which may be circular or elliptical in cross-section, of a front half of the gripping profile. The ligature-resistant grab bar also includes a bottom end cap and a top end cap attached to the ends of the elongate body.

14 Claims, 5 Drawing Sheets

(56) References Cited

U.S. PATENT DOCUMENTS

| | | | | |
|---|---|---|---|---|
| 7,373,694 | B1 | 5/2008 | Kopp | |
| 7,774,902 | B2 * | 8/2010 | Whyzel | A47K 17/022 16/436 |
| 8,646,151 | B2 | 2/2014 | Kopp et al. | |
| 9,297,154 | B2 | 3/2016 | deLoache, III et al. | |
| D792,955 | S | 7/2017 | deLoache, III | |
| D799,303 | S | 10/2017 | Boeltl | |
| 9,938,704 | B2 | 4/2018 | deLoache, III | |
| 2002/0134976 | A1 | 9/2002 | Swartz | |
| 2018/0135286 | A1 | 5/2018 | deLoache, III | |

FOREIGN PATENT DOCUMENTS

| | | | | |
|---|---|---|---|---|
| CN | 201447918 | | 5/2010 | |
| DE | 20 2017 107 351 | * | 1/2018 | F21V 33/00 |
| EP | 0 386 101 | * | 6/1992 | E04F 11/18 |
| FR | 3 047 027 | * | 7/2017 | E04F 19/02 |
| GB | 2 505 494 | * | 3/2014 | E04F 11/18 |
| JP | 2004162401 | | 6/2004 | |
| WO | WO2006003593 A1 | | 1/2006 | |

OTHER PUBLICATIONS

U.S. Appl. No. 16/001,450, filed Jun. 6, 2018, deLoache, III, et al.
Behavioral Safety Products, "Behavioral Safety Products: Safe, Aesthetic, Functional", Joint Commission 2018 Annual Behavioral Health Care Conference, downloaded from https://besafeprod.com/BSP-Product-Highlights.pdf on Oct. 23, 2018, 2 pages (pp. 1-2 in pdf).
Hunt, et al., "Behavioral Health Design Guide", Feb. 2018, edition 7.3, pp. 75, Behavioral Health Facility Consulting, LC, US.
New York State Office of Mental Health, "Patient Safety Standards, Materials and Systems Guidelines Recommended by the New York State Office of Mental Health", Aug. 15, 2018, 20$^{th}$ edition, pp. 94-97, US.

* cited by examiner

COMBINABLE LIGATURE-RESISTANT GRAB BAR FOR VERTICAL AND HORIZONTAL APPLICATION

BACKGROUND OF THE INVENTION

1. Field of the Invention

The present invention relates generally to grab bars for proving support at toilets, showers, bathtubs and other areas where persons need self-support assistance at a wall or door, and in particular, to a combinable ligature-resistant grab bar for both vertical and horizontal installation.

2. Description of the Related Art

Ligature-resistant design is a requirement in many institutional locations. In particular, in rooms where persons may be left unattended and where there is a risk that fixtures may be used as a support to tie a ligature, such as a belt, rope or a cloth, a way to ensure that the fixtures cannot be used in such a manner is desirable. In general, ligature-resistant design is an issue that exists any height above the floor, since objects above the floor can be used to support a ligature, even if one is not attachable.

Typical grab bars for self-support cannot be used in an environment where ligature support is a hazard, since such grab bars typically provide a closed void through which a ligature can be secured. Grab bars have been provided with anti-ligature features, but are typically designed for vertical applications.

Therefore, it would be desirable to provide a ligature-resistant grab bar that prevents ligature formation and/or support of such ligatures in both vertical and horizontal installations.

SUMMARY OF THE INVENTION

The above objectives, among others, are achieved in a ligature-resistant grab bar and a method of supporting a person at a wall or door with a ligature-resistant grab bar.

The ligature-resistant grab bar includes an elongate body that may be an extruded member and having a flange disposed at a planar rear surface of the elongate body and extending from the elongate body on a first side and a second side of the elongate body. The sides of the elongate body have curved side channels for drainage of water that extend from an inner edge of the flange toward a central axis of the elongate body to a gripping profile forming a front of the elongate body, which may be circular or elliptical in cross-section, of a front half of the gripping profile. The ligature-resistant grab bar also includes a bottom end cap attached to a bottom end of the elongate body and a top end cap attached to a top end of the elongate body. The top surface of the top end cap is inclined downward at an angle of greater than thirty degrees from a direction perpendicular to the rear surface of the elongate body from a rear surface of the top end cap that extends over the flange to a front surface of the top end cap that conforms to the curved side channels of the elongate body and covers the gripping profile of the elongate body at a top end thereof.

The foregoing and other objectives, features, and advantages of the invention will be apparent from the following, more particular, description of the preferred embodiment of the invention, as illustrated in the accompanying drawings.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein like reference numerals indicate like components, and:

DESCRIPTION OF ILLUSTRATIVE EMBODIMENT

The present disclosure illustrates ligature-resistant grab bars that are wall-mountable or door-mountable, and which provide ligature-resistance to prevent formation of ligatures on the grab bar.

Figure 1A:
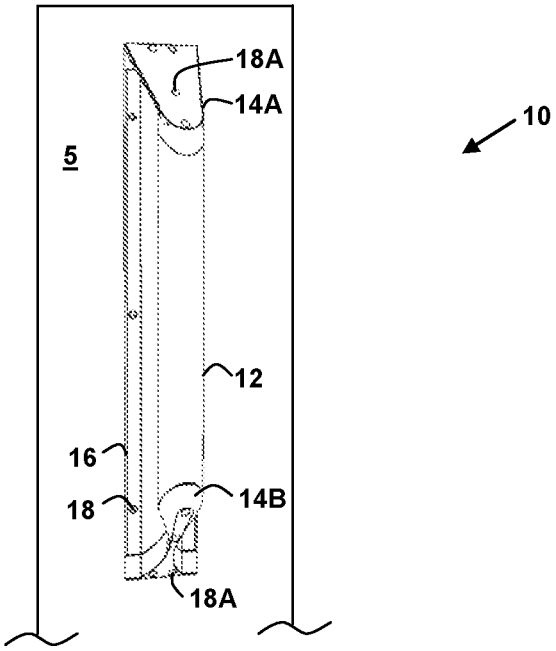
FIG. 1A is a perspective view of an installation of an example ligature-resistant grab bar 10.

Referring now to FIG. 1A, a perspective view of an installation of an example ligature-resistant grab bar 10 is shown. Ligature-resistant grab bar 10 is shown in a vertical orientation, i.e., with an elongate body 12 that forms the body of grab bar 10 having a longitudinal axis extending in the vertical direction. In contrast to typical grab bars, elongate body 12 and this ligature-resistant grab bar 10 as a whole, does not provide a gap between a wall 5 and ligature-resistant grab bar 10 through which a ligature can be formed by passing a belt or other cord behind ligature-resistant grab bar 10. Ligature-resistant grab bar 10 is mounted to wall 5 by inserting fasteners, e.g., wood screws through mounting holes 18 provided on flanges 16 at either side of ligature-resistant grab bar 10. A top end cap 14A and a bottom end cap 14B are attached to the ends of elongate body 12 by fasteners, e.g., sheet metal screws, inserted through holes 18A. Ligature-resistant grab bar 10 is laterally symmetric and suitable for either vertical or horizontal installation, and is further installable in corners, as will be illustrated below, avoiding the need for purchasing costly and specially-adapted grab bars and/or connectors. Ligature-resistant grab bar 10 can alternatively be mounted at angles between horizontal and vertical without requiring modification. If mounted in a horizontal orientation, ligature-resistant grab bar 10 can easily be wiped clean of water with a single swipe of a cloth due to the open-ended design. Ligature-resistant grab bar 10 also includes no internal gutter system or drain holes, so that bacterial and fungal growth are not promoted.

Figure 1B:
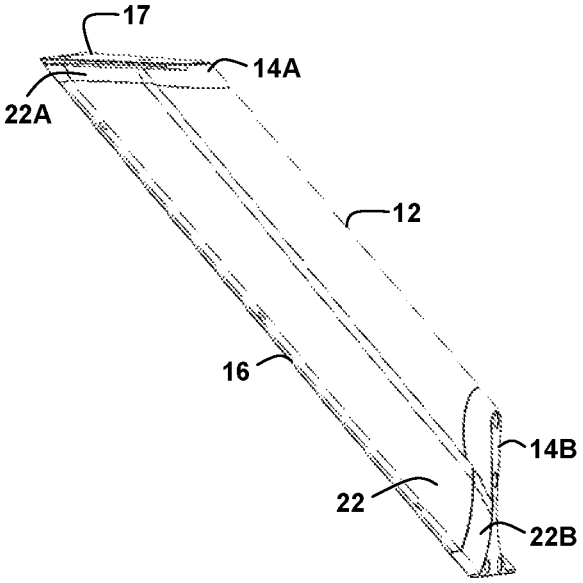
FIG. 1B is a perspective view of example ligature-resistant grab bar 10.

Referring now to FIG. 1B, a perspective view of ligature-resistant grab bar 10 is shown. Elongate body 12 includes side channels 22 that are curved to provide drainage of water for both vertical and horizontal installations of ligature-resistant grab bar 10. Bottom end cap 14B includes matching side channels 22B to provide flow of water out from the bottom of ligature-resistant grab bar 10 without interruption. Top end cap 14A has a planar top surface 17 that is inclined at an angle greater than 30° degrees downward toward elongate body 12, so that in vertical orientations (to which the terms "top" and "bottom" apply throughout), a ligature is not supportable above ligature-resistant grab bar 10. Top end cap 14A also has a side channel 22A matching side channels 22 to prevent any obstacle to drainage under the portion of top end cap 14A that provides planar top surface 17.

Figure 1C:
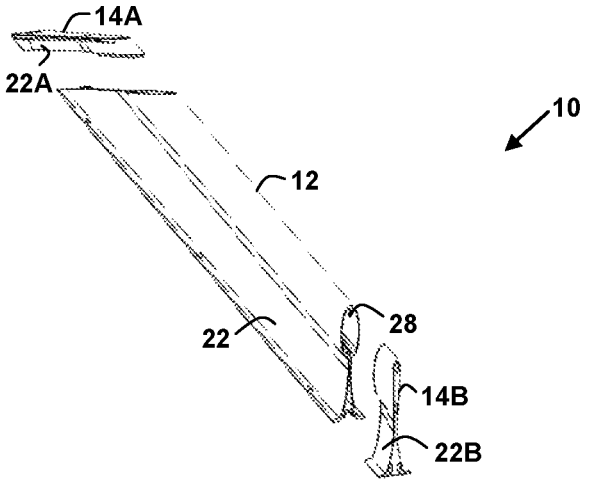
FIG. 1C is an exploded view of example ligature-resistant grab bar 10.
Figure 1D:
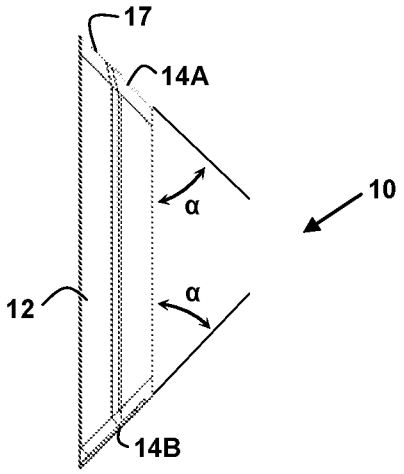
FIG. 1D is a side view of example ligature-resistant grab bar 10.

Referring now to FIG. 1C, an exploded perspective view of ligature-resistant grab bar 10 is shown. Elongate body 12, in the example embodiment, is formed from an extrusion that is cut at angles extending inward toward the front edge of ligature-resistant grab bar 10, and top end cap 14A and bottom end cap 14B are each formed with substantially parallel faces that maintain the angles when attached to elongate body 12. Since top end cap 14A and bottom end cap 14B are removable, elongate body 12 can be made any length to provide a variety of sizes of ligature-resistant grab bar 10, for example, 18", 24", 36" and 42" lengths. Circular screw profiles 28 that extend throughout the extrusion forming elongate body 12 receive the fasteners that attach top end cap 14A and bottom end cap 14B and may be pre-threaded for use with machine screws, or may be threaded by the attachment of thread-cutting sheet metal screws. As illustrated in FIG. 1D, which shows a side view of ligature-resistant grab bar 10, inward angle $\alpha$ at which the extrusion forming elongate body 12 is cut is 45°, which provides for combining two of ligature-resistant grab bars 10 in a horizontally-oriented installation by abutting the planar top surface 17 of ligature-resistant grab bars 10, as will be described in further detail below.

Figure 2A:
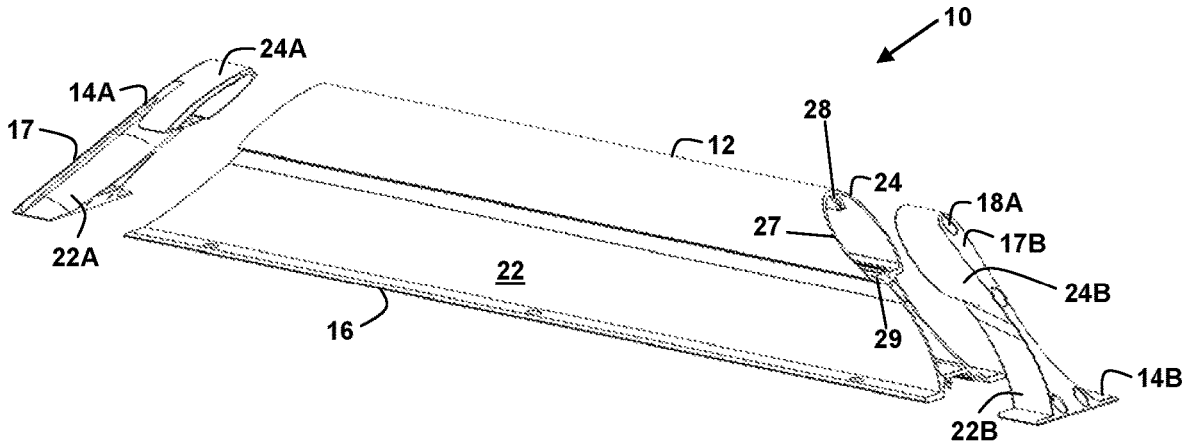
FIG. 2A is a detailed exploded view of example ligature-resistant grab bar 10.

Referring now to FIG. 2A, further details of ligature-resistant grab bar 10 are shown in a perspective view. A circular or elliptical front profile portion 24 of a grip profile 27 of elongate body 12 extends around at least the front half of grip profile 27. A flattened portion 29 of grip profile 27 extends parallel to flange 16 to provide a finger holding surface alongside side channels 22, which extend rearward from grip profile 27. Bottom end cap 14B extends side channels 22 of elongate member 12 via matching side channels 22B, and also extends grip profile 27 via a hemispherical profile 24B that tapers to a planar surface 17B that accepts fasteners through holes 18A. Top end cap 14A extends grip front profile portion 27 via a matching circular or elliptical front profile portion 24A and a matching flattened rear profile portion through a top end cap front profile portion 24A and also extends side channels 22 through matching side channels 22A up to the closure forming planar top surface 17.

Figure 2B:
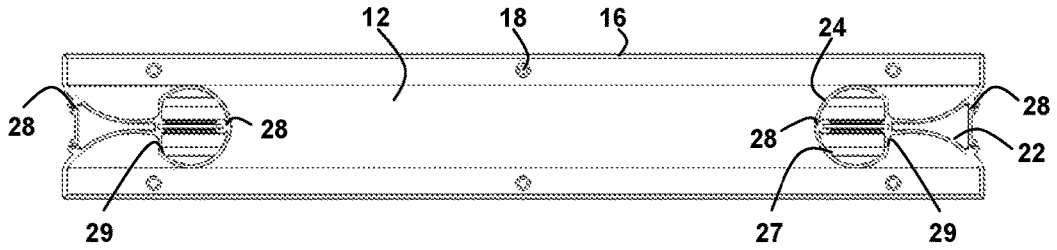
FIG. 2B is a top views of example ligature-resistant grab bar 10.

Referring now to FIG. 2B, a top view of elongate body 12 is shown, in which circular screw profiles 28 and the shape of grip profile 27 including circular or elliptical front profile portion 24 and flattened portion 29 are shown, as well as the hollow form of the interior of the extrusion forming elongate body 12.

Figure 3A:
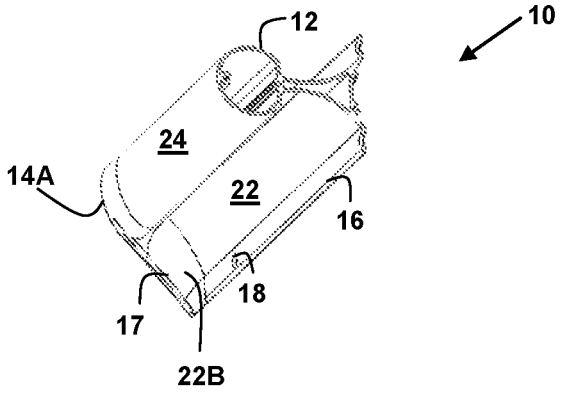
FIG. 3A is a cross-section view of example ligature-resistant grab bar 10.

Referring now to FIG. 3A, a perspective detail view of a top end of elongate body 12 and top end cap 14A show the extension of side channel 22 of elongate body 12 into side channel 22B of top end cap 14A, which flares out to the top of top end cap 14A that provides planar top surface 17.

Figure 3B:
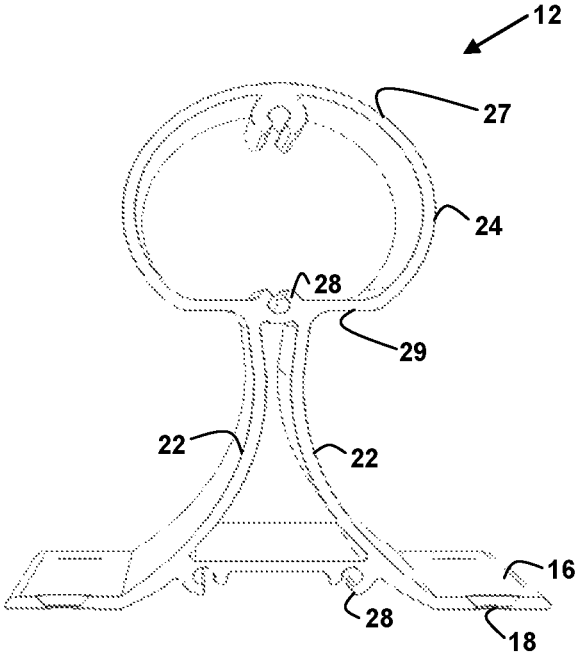
FIG. 3B is a cross-section view of elongate body 12 of example ligature-resistant grab bar 10.

Referring now to FIG. 3B, a cross-section detail view of elongate body 12 is shown, further illustrating the shape of grip profile 27 including circular or elliptical portion 24 and flattened portion 29, along with side channels 22 and flange 16.

Figure 4A:
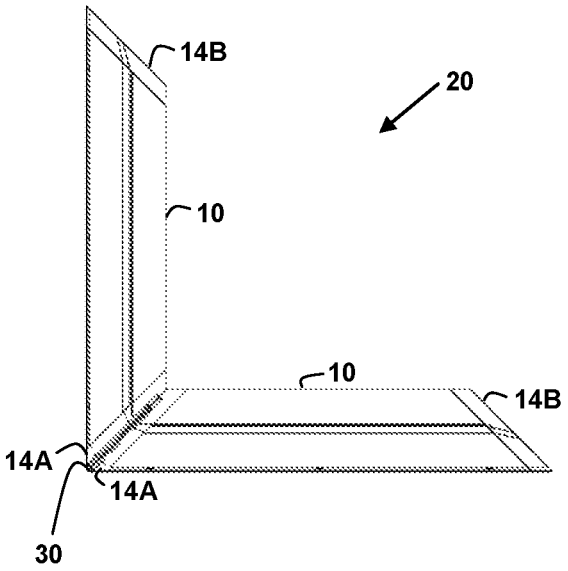
FIG. 4A is a top view and FIG. 4B is a perspective view of an installation of two example ligature-resistant grab bars 10 in a horizontal orientation.
Figure 4B:
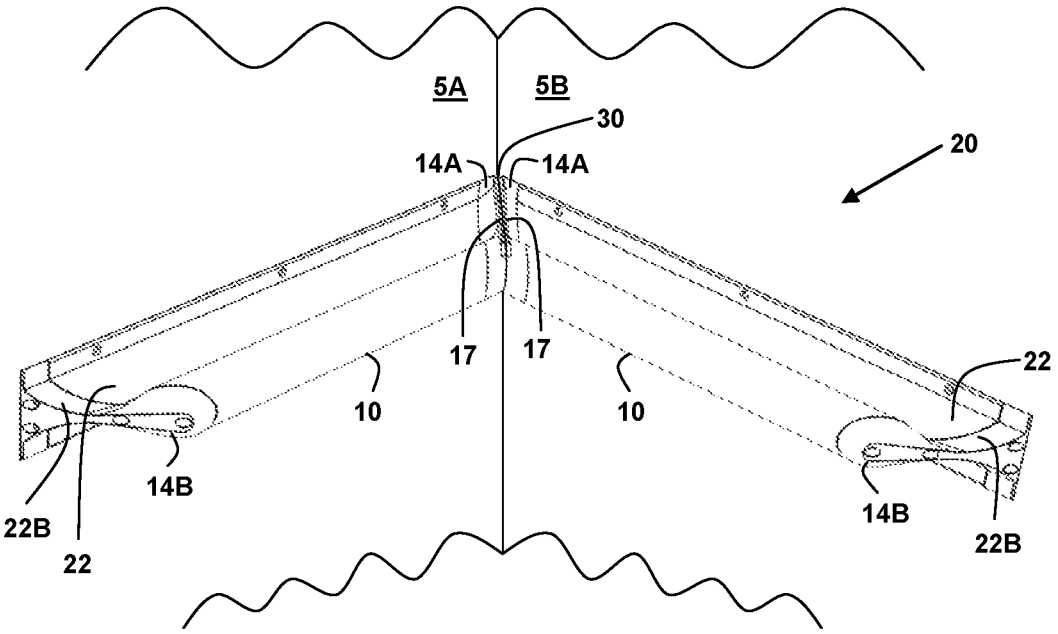

Referring now to FIG. 4A and FIG. 4B, a top view and a perspective view, respectively, of an installation 20 of two of example ligature-resistant grab bars 10 is shown. Ligature-resistant grab bars 10 are installed horizontally at a corner formed by two walls 5A and 5B so that planar top surfaces 17 of each of top end caps 14A of ligature-resistant grab bars 10 are abutted to prevent formation of a gap. In practice, ligature-resistant grab bars 10 will be inclined downward at an angle between 1° and 10° to promote drainage of water through side channels 22, 22B and caulk 30 is applied to the upper edges of planar top surfaces 17 in the installation to seal any gap through which a ligature might otherwise be inserted.

While the invention has been particularly shown and described with reference to the preferred embodiment thereof, it will be understood by those skilled in the art that the foregoing and other changes in form, and details may be made therein without departing from the spirit and scope of the invention.

What is claimed is:

1. A ligature-resistant grab bar for supporting a person at a wall or door, comprising:

an elongate body formed by a hollow extruded member having a flange disposed at a planar rear surface of the elongate body and extending from the elongate body on a first side and a second side thereof, and curved side channels for drainage of water that extend from an inner edge of the flange toward a central axis of the elongate body to a gripping profile forming a front of the elongate body, and wherein the curved side channels extend inward between the front of the elongate body and the planar rear surface to form concavities on an exterior of the elongate body on the first side and the second side thereof and that extend from the inner edge of the flange to the gripping profile on each side of the elongate body, wherein the flange includes a plurality of voids for mounting the elongate body to a wall on the first side and the second side thereof, and wherein a top end of the elongate body is inclined at an angle of forty-five degrees from a direction perpendicular to the planar rear surface of the elongate body from the planar rear surface to the front of the elongate body;

a bottom end cap attached to a bottom end of the elongate body and having concave sides that conform to a bottom end of the curved side channels of the elongate body, wherein the concave sides of the bottom end cap extend to a bottom surface of the bottom end cap so that water flow from the curved side channels of the elongate body is not interrupted by the bottom end cap;

a top end cap attached to the top end of the elongate body, wherein a top surface of the top end cap is inclined inward toward the elongate body at the angle of forty-five degrees from the direction perpendicular to the planar rear surface of the elongate body from a rear surface of the top end cap that extends over the flange to a front surface of the top end cap that conforms to the curved side channels of the elongate body and covers the gripping profile of the elongate body at a top end thereof, and wherein the top surface of the top end cap is parallel to a bottom surface of the top end cap along an area of contact between the top end cap and the elongate body so that the top end cap conforms to and makes a sealed connection with the elongate body, and wherein no portion of the elongate body extends beyond a top face of the top end cap, so that two of the ligature-resistant grab bars are joinable in a horizontal configuration such that the planar surface of the top end cap substantially abuts another planar surface of a top end cap of another grab bar when the two of the ligature-resistant grab bars are joined in a horizontal configuration; and fasteners that extend from the bottom surface of the top end cap and the top surface of the bottom end cap into corresponding mating profiles formed on an inner surface of the hollow extruded member.

2. The ligature-resistant grab bar of claim 1, wherein the gripping profile forming the front of the elongate body has an elliptical or semi-circular profile extending around at least a front half of the gripping profile.

3. The ligature-resistant grab bar of claim 2, wherein the gripping profile forming the front of the elongate body has rear surfaces forming a rear half of the gripping profile that extend parallel to the planar rear surface of the elongate body to provide flat surfaces for finger-gripping.

4. The ligature-resistant grab bar of claim 3, wherein ends of the hollow extruded member are cut at an angle extending inward 45 degrees from the planar rear surface of the elongate body to a front edge of the elongate body, and wherein a top surface of the bottom end cap and a bottom surface of the top end cap are also inclined inward 45 degrees to mate with the corresponding ends of the elongate body, and whereby the ends of the elongate body form interchangeable ends that will accept either of the top end cap and the bottom end cap.

5. The ligature-resistant grab bar of claim 1, wherein the fasteners comprise threaded fasteners that extend through holes in the top end cap and the bottom end cap into circular profiles sized to secure the threaded fasteners.

6. The ligature-resistant grab bar of claim 1, wherein a bottom surface of the bottom end cap has a partially hemispherical profile extending from a junction between the bottom surface of the elongate body around the gripping profile.

7. A ligature-resistant grab bar for supporting a person at a wall or door, comprising:

a hollow extrusion that has a flange disposed at a planar rear surface of the hollow extrusion and extending from the hollow extrusion on a first side and a second side thereof, and curved side channels for drainage of water that extend from an inner edge of the flange toward a central longitudinal axis of the hollow extrusion to a gripping profile forming a front of the hollow extrusion and having an elliptical profile extending around a front half of the gripping profile and has rear surfaces that extend parallel to the planar rear surface of the hollow extrusion to provide flat surfaces for finger-gripping, and wherein the curved side channels extend inward between the front of the hollow extrusion body and the planar rear surface to form concavities on an exterior of the hollow extrusion on the first side and the second side thereof and that extend from the inner edge of the flange to the gripping profile on each side of the elongate body, wherein the flange includes a plurality of voids for mounting the hollow extrusion to a wall on the first side and the second side thereof;

a bottom end cap attached to a bottom end of the hollow extrusion via fasteners extending into circular profiles formed on an inner surface of the hollow extrusion; and a top end cap attached via fasteners to a top end of the hollow extrusion via fasteners extending into circular profiles formed on the inner surface of the hollow extrusion, wherein the top surface of the top end cap is inclined inward toward the hollow extrusion at an angle of forty-five degrees from a direction perpendicular to the planar rear surface of the hollow extrusion from a rear surface of the top end cap that extends over the flange to a front surface of the top end cap that conforms to the curved side channels of the hollow extrusion and covers the gripping profile of the hollow extrusion at a top end thereof, wherein ends of the hollow extrusion are cut at an angle extending inward forty-five degrees from the planar rear surface of the hollow extrusion to a front edge of the hollow extrusion, and wherein a top surface of the bottom end cap and a bottom surface of the top end cap are also inclined inward at an angle of forty-five degrees to mate with the corresponding ends of the hollow extrusion, and whereby the ends of the hollow extrusion form interchangeable ends that will accept either of the top end cap and the bottom end cap, wherein a bottom surface of the bottom end cap has a partially hemispherical profile extending from a junction between the bottom surface of the hollow extrusion around the gripping profile, wherein sides of the bottom end cap and sides of the top end cap that abut the curved side channels of the hollow extrusion have a curvature that matches the curved side channels of the hollow extrusion, and, wherein the curvature of the side of the bottom end cap extends to a bottom surface of the bottom end cap so that water flow from the side channels of the hollow extrusion is not interrupted by the bottom end cap, and wherein the top surface of the top end cap is parallel to a bottom surface of the top end cap along an area of contact between the top end cap and the elongate body so that the top end cap conforms to and makes a sealed connection with the hollow extrusion, and wherein no portion of the elongate body extends beyond a top face of the top end cap, so that two of the ligature-resistant grab bars are joinable in a horizontal configuration such that the planar surface of the top end cap substantially abuts another planar surface of a top end cap of another grab bar when the two of the ligature-resistant grab bars are joined in a horizontal configuration.

8. A method of providing self-support of a person at a wall or door, the method comprising:

providing an elongate body of a grab bar;

attaching a bottom end cap to a bottom end of the elongate body, the elongate body having a flange disposed at a planar rear surface of the elongate body and extending from the elongate body on a first side and a second side thereof, and curved side channels for drainage of water that extend from an inner edge of the flange toward a central axis of the elongate body to a gripping profile forming a front of the elongate body, wherein the curved side channels extend inward between the front of the elongate body and the planar rear surface to form concavities on an exterior of the elongate body on the first side and the second side thereof and that extend from the inner edge of the flange to the gripping profile on each side of the elongate body, wherein the flange includes a plurality of voids for mounting the elongate body to a wall on the first side and the second side thereof, and wherein a top end of the elongate body is inclined at an angle of forty-five degrees from a direction perpendicular to the planar rear surface of the elongate body from the planar rear surface to the front of the elongate body, and wherein the bottom end cap has concave sides that conform to a bottom end of the curved side channels of the elongate body, wherein the concave sides of the bottom end cap extend to a bottom surface of the bottom end cap so that water flow from the curved side channels of the elongate body is not interrupted by the bottom end cap;

attaching a top end cap at a top end of the elongate body, wherein a top surface of the top end cap is inclined inward toward the elongate body at an angle of greater than thirty degrees from a direction perpendicular to the planar rear surface of the elongate body from a rear surface of the top end cap that extends over the flange to a front surface of the top end cap that conforms to the curved side channels of the elongate body and covers the gripping profile of the elongate body at a top end thereof, and wherein the top surface of the top end cap is parallel to a bottom surface of the top end cap along an area of contact between the top end cap and the elongate body so that the top end cap conforms to and makes a sealed connection with the elongate body, and wherein no portion of the elongate body extends beyond a top face of the top end cap, so that two of the ligature-resistant grab bars are joinable in a horizontal configuration such that the planar surface of the top end cap substantially abuts another planar surface of a top end cap of another grab bar when the two of the ligature-resistant grab bars are joined in a horizontal configuration; and mounting the elongate body to the wall or door with fasteners extending through the flange;

wherein the attaching a top end cap and the attaching a bottom end cap attach fasteners that extend from the bottom surface of the top end cap and the top surface of the bottom end cap into corresponding mating profiles formed on an inner surface of the elongate body.

9. The method of claim 8, wherein the elongate body is a first elongate body and wherein the method further comprises:

providing a second elongate body; and repeating the attaching the bottom end cap and the attaching the top end cap for a second bottom end cap and a second top end cap to form two different grab bars, wherein the mounting mounts the grab bars with the first elongate body and the second elongate body oriented substantially horizontally and with the top surfaces of the top end caps in contact with each other.

10. The method of claim 9, wherein the mounting of the two different grab bars inclines the bottom ends of the two different grab bars downward at an angle between one and ten degrees to provide drainage of water, and further comprising caulking a gap between edges of the top end caps of the two different grab bars at least at an upper edge of an assembly of the two different grab bars to fill a gap resulting from inclining the two different grab bars.

11. The method of claim 8, wherein the elongate body having the gripping profile has an elliptical or semi-circular profile extending around at least a front half of the gripping profile.

12. The method of claim 11, wherein the the gripping profile forming the front of the elongate body has rear surfaces forming a rear half of the gripping profile that extend parallel to the planar rear surface of the elongate body to provide flat surfaces for finger-gripping.

13. The method of claim 12, wherein further comprising cutting ends of the hollow extruded member at an angle extending inward 45 degrees from the planar rear surface of the elongate body to a front edge of the elongate body, and wherein a top surface of the bottom end cap and a bottom surface of the top end cap are also inclined inward 45 degrees to mate with the corresponding ends of the elongate body, and whereby the ends of the elongate body form interchangeable ends that will accept either of the top end cap and the bottom end cap.

14. The method of claim 8, wherein a bottom surface of the bottom end cap has a partially hemispherical profile extending from a junction between the bottom surface of the elongate body around the gripping profile.

* * * * *